United States Patent [19]

Bober

[11] Patent Number: 4,643,705

[45] Date of Patent: Feb. 17, 1987

[54] POSITIVE DRIVE KNIFE FOLDER

[75] Inventor: Henry T. Bober, Fairport, N.Y.

[73] Assignee: Xerox Corporation, Stamford, Conn.

[21] Appl. No.: 759,707

[22] Filed: Jul. 29, 1985

[51] Int. Cl.[4] ..... B65H 45/18

[52] U.S. Cl. ..... 493/444; 493/443

[58] Field of Search ..... 493/444, 445, 443, 442, 493/419

[56] References Cited

U.S. PATENT DOCUMENTS 538,609 4/1895 Dexter ..... 493/445 X 1,124,375 1/1915 Wood .

4,419,088 12/1983 Nemec ..... 493/444

4,508,527 4/1985 Uno et al. ..... 493/357

*Primary Examiner*—James F. Coan

*Attorney, Agent, or Firm*—William A. Henry, II

[57] ABSTRACT

An improved knife folder includes a blade adapted to collapse a sheet a predetermined amount in order to allow nip rollers to buckle the sheet into a pair of folding cylinders. In this manner, potential for blade damage to the sheet and a critical set up are eliminated while at the same time insuring positive paper acquisition.

11 Claims, 4 Drawing Figures

POSITIVE DRIVE KNIFE FOLDER

This invention relates generally to a knife folder for use with an electrophotographic printing machine, and more particularly concerns an improved knife folder apparatus.

As cut and folded web sections emerge from other press folder operations, they often are given a final fold by means of a blade which descends in a chopping motion when a sheet is in position under it. The blade pushes the sheet down between two nip rollers, creating a fold at that point. A knife folder requires deskewed and centered copy over the folding nip rollers or the sheet may be folded off center or crooked. Also, caution in the blade positioning relative to the nip rollers is essential or the sheet may be damaged or acquired too slowly. Accordingly, it is highly desirable to simplify the folding of sheets without damage while at the same time improving the reliability of the folder. The following disclosures appear relevant:

U.S. Pat. No. 1,124,375, Patentee: Wood, Issued: Jan. 12, 1915.

U.S. Pat. No. 4,508,527, Patentee: Uno et al., Issued: Apr. 2, 1985.

The pertinent portions of the foregoing disclosures may be briefly summerized as follows:

Wood discloses a folding and stapling device in which a folder blade drives and creases collected sheets into a receiving head and clips of an arm member.

Uno et al. discloses a method and apparatus for quantitatively dividing zig-zag folded sheets. A sheet of paper having a plurality of linear perforations is continuously transferred vertically through a roller and is folded in zig-zag form by operation of a crank mechanism.

In accordance with the present invention, there is provided an improved knife folder in which a blade collapses a sheet into position to be gently buckled by nip rollers into a nip formed by a pair of folding cylinders that apply a final fold to the sheet and thereby insuring positive acquisition of the sheet, elimination of a critical set up and the potential for knife related copy damage while reducing potential for disturbing the centering of the sheet over the folding cylinders.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to designate identical elements.

Figure 1:
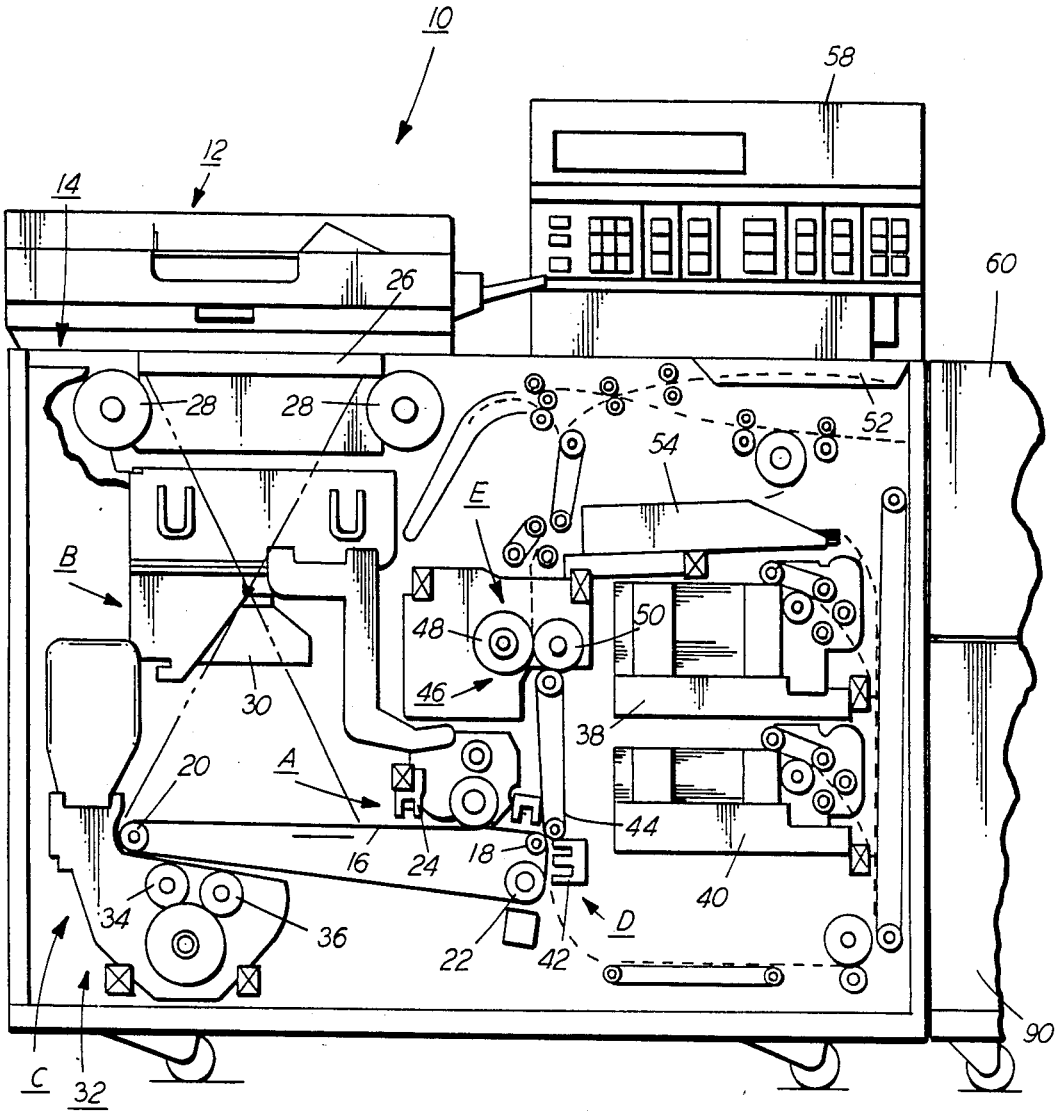
FIG. 1 is a schematic showing an electrophotographic machine feeding sheets to be folded by the improved folder of the present invention. However, it will become apparent from the following discussion that the present folder could be used to fold sheets from any machine, and is not limited to the embodiment shown herein.

Turning now to FIG. 1, printing machine 10 includes conventional controller 58 and a recirculating document handling system 12 for advancing successive original documents onto the platen of the processing module 14. Inasmuch as the art of electrophotographic printing is well known, the operation of the various processing stations employed in processing module 14 will be described briefly.

Processing module 14 employs a belt 16 having a photoconductive surface deposed on a conductive substrate. Preferably the photoconductive surface is made from a selenium alloy with the conductive substrate being preferably made from an aluminum alloy which is electrically grounded. Belt 16 advances successive portions of the photoconductive surface sequentially through the various processing stations disposed about the path of movement thereof. Belt 16 is entrained about stripping roller 18, tensioning roller 20 and drive roller 22. Drive roller 22 is coupled to a suitable motor so as to rotate and advance belt 16.

Initially, a portion of belt 16 passes through charging station A. At charging station A, a corona generating device 24 charges the photoconductive surface of belt 16 to a relatively high, substantially uniform potential.

After the photoconductive surface of belt 16 is charged, the charged portion thereof is advanced through exposure station B. At exposure station B, an original document is advanced by the recirculating document handling system 12 to a transparent platen 26. Lamps 28 flash light rays onto the original document. The light rays reflected from the original document are transmitted through lens 30 forming a light image thereof. Lens 30 focuses the light image onto the charged portion of the photoconductive surface to selectively dissipate the charge thereon. This records an electrostatic image on the photoconductive surface of belt 16 which corresponds to the informational areas contained within the original document.

Thereafter, belt 16 advances the electrostatic latent image recorded on the photoconductive surface to development station C. At development station C a magnetic brush development system, indicated generally by the reference numeral 32, advances developer material into contact with the latent image. Preferably, magnetic brush development system 32 includes two magnetic brush developer rollers 34 and 36. Each roller advances developer material into contact with the latent image. These rollers form a brush of carrier granules and toner particles extending outwardly therefrom. The latent image attracts the toner particles from the carrier granules forming a toner powder image on the photoconductive surface of belt 16.

After the electrostatic latent image is developed, belt 16 advances the toner powder image to transfer station D. A sheet of support material is advanced to transfer station D from a copy sheet stack supporting apparatus 38 or 40. Transfer station D includes a corona generating device 42 which sprays ions onto the backside of the copy sheet. This attracts the toner powder image from the photoconductive surface to the copy sheet. After transfer, the copy sheet moves onto conveyor 44 which advances the sheet to fusing station E.

Fusing station E includes a fuser assembly, indicated generally by the reference numeral 46, which permanently affixes the transferred powder image to the copy sheet. Preferably, fuser assembly 46 comprises a heated fuser roller 48 and a back-up roller 50. The copy sheet passes between the fuser roller and back-up roller with the toner powder image contacting the fuser roller. In this manner, the toner powder image is permanently affixed to the copy sheet. After fusing, the copy sheet is either advanced to output tray 52, returned to duplex tray 54 for subsequent recycling so as to enable a toner powder image to be transferred to the other side thereof, or if folding is required, directed into folder 60 that is partially supported by castor mounted support 90. The detailed structure of knife folder 60 will be described hereinafter with reference to FIGS. 2–4.

Figure 2:
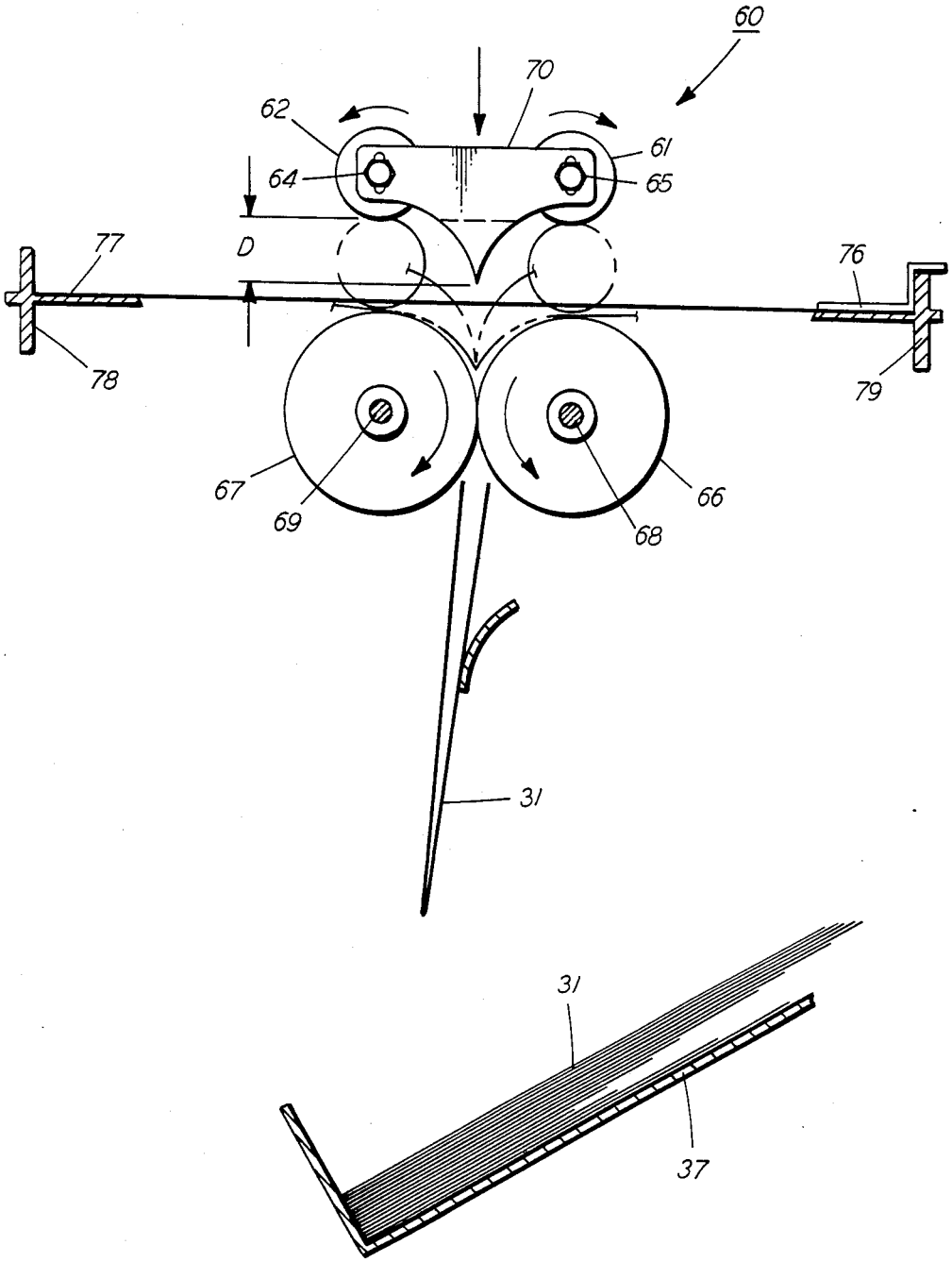
FIG. 2 is a fragmentary elevational end view of FIG. 3 along line A—A.

Referring now to FIG. 2, there is shown a fragmentary elevational view illustrating positive drive knife folder 60 in greater detail. As depicted thereat, knife folder 60 includes a blade 70 that is fixedly secured by bolts 64 and 65 to rods 72 (not shown) and 73. Also mounted on the rods are nip rollers 61, 62, 63 and a fourth nip roller not shown with both the nip rollers and the blade being moveable up and down by conventional means a predetermined distance D as shown in FIG. 2. The function of blade 70 is to buckle the sheet, and begin to direct it into the folding nip between cylinders 66 and 67. The improvement of this particular blade control of sheets is that the sheets are positioned over the folding cylinders in the precise time required by the machine feeding the sheets without damage to the sheets. The key feature of the present invention is that a buckling blade 70 is used only to facilitate downward collapse of a sheet the predetemined distance D. The continued movement of the blade downward brings nip rollers 61 and 62 into engagement with folding rollers 66 and 67 without the point of blade 70 coming in contact with either roller 66 or 67 or the nip formed between the two rollers. The contact between nip rollers 61 and 62 and folding rollers 66 and 67 and having a sheet 31 therebetween causes the sheet to continue to gently buckle down into the folding nip between rollers 66 and 67. As a result, positive acquisition of the sheet in the folding nip is obtained without damage to the sheet by the blade while at the same time reducing the potential of sheet movement over the center of the folding nip.

The knife folder apparatus 60 is adjusted at 78 for handling a wide variety of sheet sizes. To make an adjustment, all one need do is move adjustable guide 78 toward fixed support 79. The sheets are supported on member 77 for transport into the folder and registered against members 76 and after folding has occurred the folded sheets exit folding cylinders 66 and 67 and are guided by appropriate baffles into catch tray 37. The folding cylinders 66 and 67 are driven by conventional means on shafts 68 and 69. If one desired, rollers 61 and 62 could be the drive rollers and rollers 66 and 67 idler rollers. Registration members 76 are slidable backwards and forwards to adjust for various incoming sheet sizes.

Figure 3:
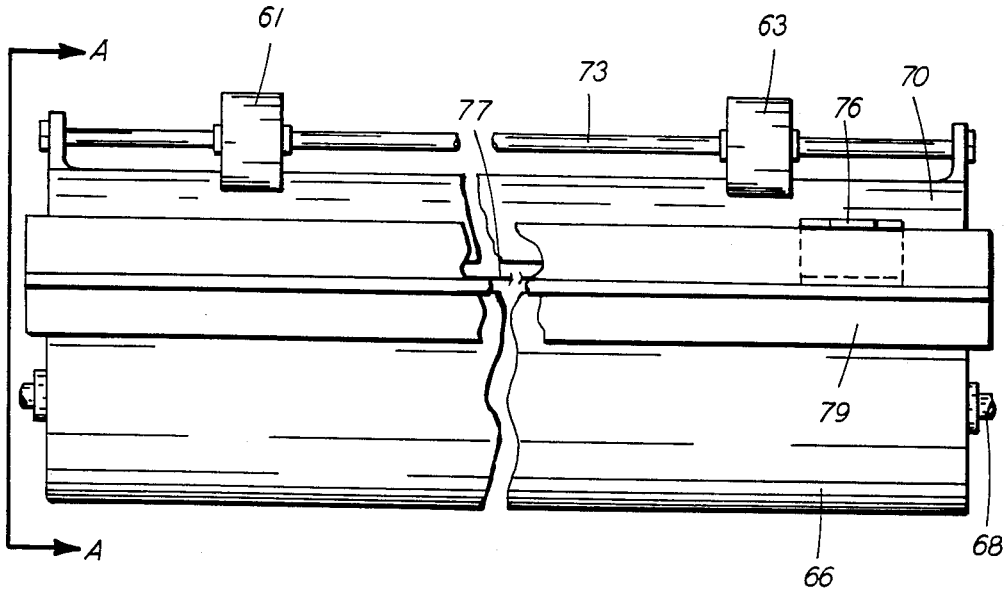
FIG. 3 is a partial side view of the apparatus of the present invention.
Figure 4:
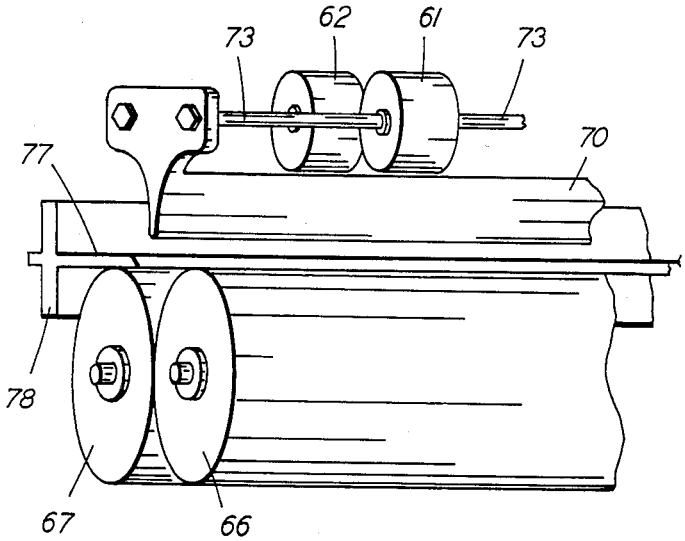
FIG. 4 is a partial isometric view of the knife folder of the present invention showing the relationship between the knife, nip rollers and folding cylinders.

In reference to FIGS. 3 and 4, it can be seen that the improved folder 60 is quite different from a knife folder where the knife driving the sheet into the folding nip creates the fold. In contrast, the knife folder of the present invention employs a blade 70 which bends a sheet 31 to establish a buckle in the sheet and gently but positively directs the sheet into pinch rollers 61 and 63 as shown in FIG. 3 for folding. The pinch rollers may be stationary until the buckle of the sheet by knife 70 is established, then actuated to crease the sheet in conjunction with rollers 66 and 67. This reduces the potential for disturbance of a copy being centered over pinch rollers 66 and 67 as well as other damage to the copy that could be caused by knife action. As can be seen from FIG. 4, the knife or buckling blade 70 contacts the copy sheet 31 before nip or pinch rollers 61 and 62 but does not jam the sheet into folding cylinders 66 and 67. Once actuated by controller 58, knife 70 insures downward collapse of the copy sheet into the cylinders 66 and 67. The positive drive of the nip rollers will reliably introduce the copy sheet into the folding cylinder nip between rollers 66 and 67. The blade will then insure the downward direction of collapse of the copy sheet. By protruding the blade just below the nip rollers, the disturbance of the copy sheet is minimal and there is no likelyhood of damaging the copy sheet by jamming the blade into the folding cylinder nip.

It should now be apparent that an improved knife folder has been disclosed that insures the folding of a sheet along a predictable centerline without risk of damage to the sheet. The folder employs a blade and nip rollers to buckle a sheet into a folding cylinder pair with the folding cylinder pair taking the initially buckled sheet and applying a permanent fold in the sheet and then passing the sheet into an output tray. The nip rollers work in conjunction with the folding cylinder pair to gently turn an initial buckle in the sheet into a complete fold.

What is claimed is:

1. A knife folder adapted to fold a sheet after it exits a previous working station, said folder having a pair of folding cylinders that place final folds in sheets and a blade that guides sheets toward said cylinders, the improvement comprising:

nip means positioned adjacent to said folding cylinders and for non-relative movement with respect to said blade; and support means for supporting said blade and said nip means, said support means being adapted for movement through a predetermined distance such that as said support means is moved said blade contacts the sheet and causes it to collapse toward said folding cylinders and continued movement of said support means brings said nip means into engagement with said folding cylinders and the sheet, whereby the sheet is driven into a nip formed between said folding cylinders by said nip means and folded.

2. The knife folder of claim 1, including said guide means for adjusting said knife folder to accommodate a wide variety of sheet sizes.

3. The knife folder of claim 1, including means for registering sheets over said folding cylinders.

4. A knife folder adapted to fold sheets exiting an output station, comprising:

a pair of folding cylinders;

registration stops for registering the sheets over said folding cylinders;

a bucking blade for buckling sheets toward a nip formed between said folding cylinders;

a pair of nip rollers positioned above said folding cylinders and adapted for non-relative movement with respect to said buckling blade; and support means for supporting said buckling blade and said nip rollers, said support means being adapted for movement through a predetermined distance causing said buckling blade to buckle the sheets into the nip formed between said folding cylinders and mating of said nip rollers with the sheets and said folding cylinders whereby sheets are driven into said folding cylinders, folded and exited therefrom for further processing.

5. The knife folder of claim 4, wherein said folding cylinders are driving cylinders and said nip rollers are idler rollers.

6. The knife folder of claim 4, wherein said nip rollers are drive rollers and said folding cylinders are idler cylinders.

7. The knife folder of claim 5, including means for adjusting said knife folder to accommodate a wide variety of sheet sizes.

8. A knife folder, comprising:

a set of folding cylinders;

a set of nip rollers; and a blade positively secured to said set of nip rollers and adapted to collapse a sheet into position to be gently buckled by said nip rollers into a nip formed by said folded cylinders that apply a final fold to the sheet, thereby insuring positive control of the sheet while minimizing the possibility of blade damage to the sheet.

9. The knife folder of claim 8, wherein said blade is adapted for movement and said movement is terminated a distance removed from said nip formed by said folding cylinders.

10. A knife folder for applying final folds to sheets, comprising:

a plurality of folding cylinders;

a plurality of nip rollers;

a registration means;

a knife mounted for movement toward and away from said folding cylinders and for non-relative movement with respect to said plurality of nip rollers;

support means for supporting said knife and said nip rollers; and control means adapted for actuation once a sheet contacts said registration means to move said support means through a predetermined distance toward said folding cylinders whereby said knife applies a buckle toward said folding cylinders in the sheet and afterwards said nip rollers are brought into contact with the sheet and said folding cylinders such that the sheet is completely buckled into a nip formed between said folding cylinders.

11. In a copier having a means for reproducing images of original documents onto copy sheets, and means for folding the copy sheets, the improvement in the means for folding the copy sheets, characterized by: a set of folding cylinders, a blade adapted to collapse a copy sheet, and a set of nip rollers, said nip rollers being adapted for non-relative movement with respect to said blade while said blade is adapted to be moved toward said folding cylinders in order to collapse the copy sheet into position to be gently buckled by said nip rollers into a nip formed by said folding cylinders that apply a final fold to the copy sheet, thereby insuring positive control of the copy sheet while minimizing the possibility of blade damage to the copy sheet.

* * * * *